US006811371B2

(12) United States Patent
Mantovani

(10) Patent No.: US 6,811,371 B2
(45) Date of Patent: Nov. 2, 2004

(54) RAPID TOOL COUPLING DEVICE FOR DIGGER TOOLS

(75) Inventor: Alberto Mantovani, Finale Emilia (IT)

(73) Assignee: Mantovanibenne S.r.l., Mirandola (IT)

( * ) Notice: Subject to any disclaimer, the term of this patent is extended or adjusted under 35 U.S.C. 154(b) by 49 days.

(21) Appl. No.: 10/290,533

(22) Filed: Nov. 8, 2002

(65) Prior Publication Data

US 2003/0095858 A1 May 22, 2003

(30) Foreign Application Priority Data

Nov. 19, 2001 (EP) ..... 01204404

(51) Int. Cl.[7] ..... F16D 1/06
(52) U.S. Cl. ..... 414/723; 37/468
(58) Field of Search ..... 414/723; 37/468

(56) References Cited

U.S. PATENT DOCUMENTS 5,423,625 A * 6/1995 Gebauer et al. ..... 414/723 X
5,549,440 A 8/1996 Cholakon et al.
5,927,665 A 7/1999 Grabnic
6,158,950 A 12/2000 Wilt et al.
6,233,852 B1 5/2001 Pemberton
6,438,875 B1 * 8/2002 Kimble et al. ..... 37/468

FOREIGN PATENT DOCUMENTS

| | | |
|---|---|---|
| DE | 93 19 362 | 3/1994 |
| GB | 2 330 570 | 4/1999 |
| JP | 2000-129713 | 5/2000 |

* cited by examiner

*Primary Examiner*—Donald W. Underwood
(74) *Attorney, Agent, or Firm*—Young & Thompson

(57) ABSTRACT

In the rapid tool coupling device for digger tools, a tool is provided with two pivots operating as means for hooking-up, the tool comprising: a body provided with mobile hooks which are actuated to achieve stable removable couplings with at least one of the two pivots. At least one plurality of first supports and at least one second support, are predisposed to couple with a corresponding plurality of pairs of the two pivots, which pairs comprise a first pivot and a second pivot, and which can be removably fixed to the body.

8 Claims, 3 Drawing Sheets

1
8
3
50
7
5
4
2
60
6

RAPID TOOL COUPLING DEVICE FOR DIGGER TOOLS

BACKGROUND OF THE INVENTION

Specifically, though not exclusively, the invention is usefully applied for all tools, in particular buckets, which are hooked up using two parallel pivots predisposed on the bucket, which are used for hooking up to a rapid-coupling device provided on the end of the digger manoeuvring arm.

Numerous manufacturers of diggers and digger tools exist on the market. Also numerous are the different types of attachments, which are generally dimensioned and configured so that only tools having complementary attachments can be hooked up to them.

All this constitutes a serious limitation to tool use, as it is not easy to obtain a full range of tools, buckets or otherwise, for a single digger.

The main aim of the present invention is to provide a rapid coupling device which obviates the limitations of the prior art with a simple solution.

These aims and advantages and others besides are all achieved by the present invention, as it is characterised in the appended claims.

SUMMARY OF THE INVENTION

The main aim of the present invention is to provide a rapid coupling device which obviates the limitations of the prior art with a simple solution.

These aims and advantages and others besides are all achieved by the present invention, as it is characterised in the appended claims.

BRIEF DESCRIPTION OF THE DRAWINGS

Further characteristics and advantages of the present invention will better emerge from the detailed description that follows of an embodiment of the invention, illustrated by way of example and not to be considered limiting in the accompanying figures of the drawings, in which.

DESCRIPTION OF THE PREFERRED EMBODIMENTS

Figure 1:
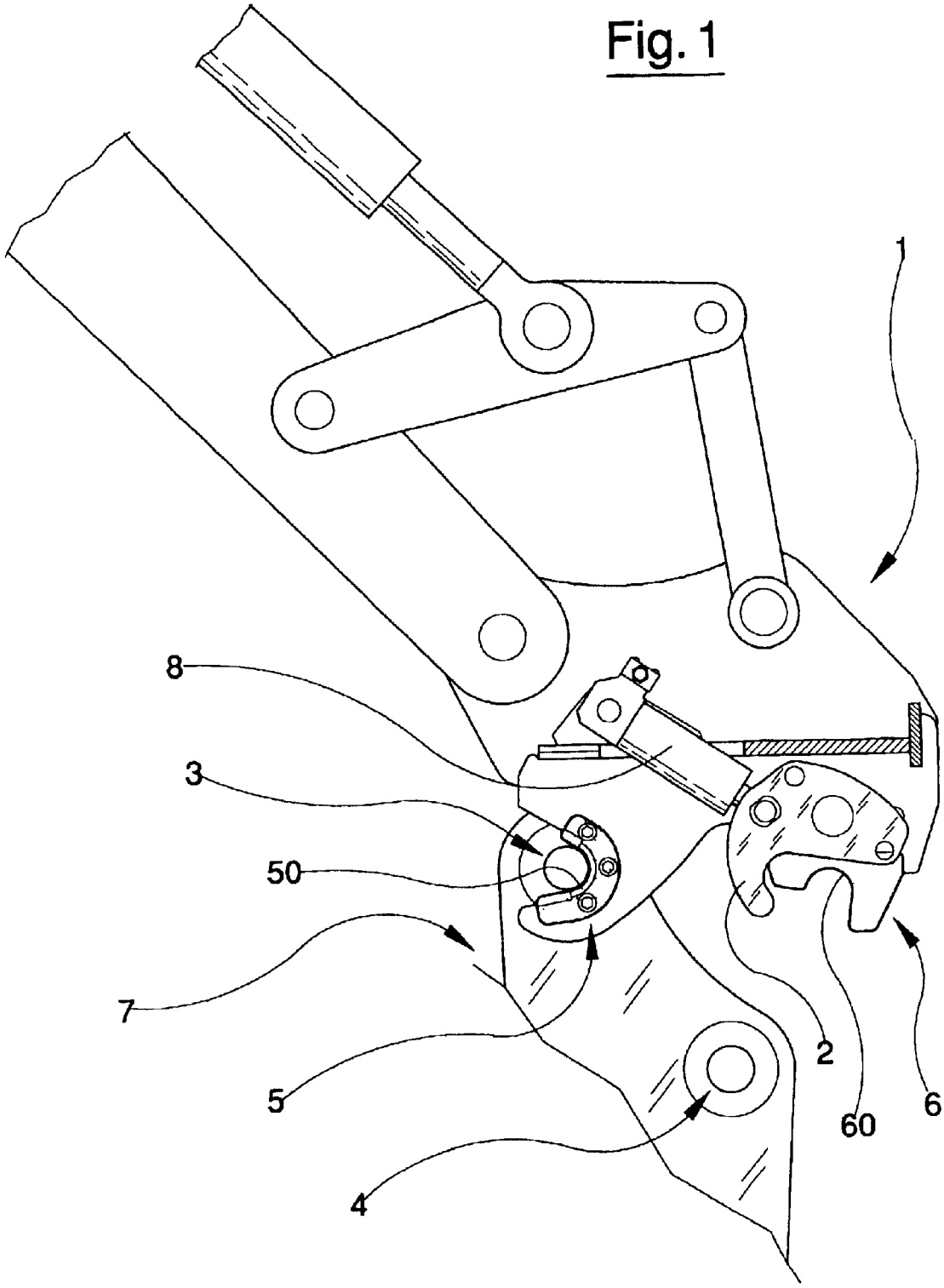
FIG. 1 is a partially-sectioned schematic side view according to line III—III of FIG. 3.
Figure 3:
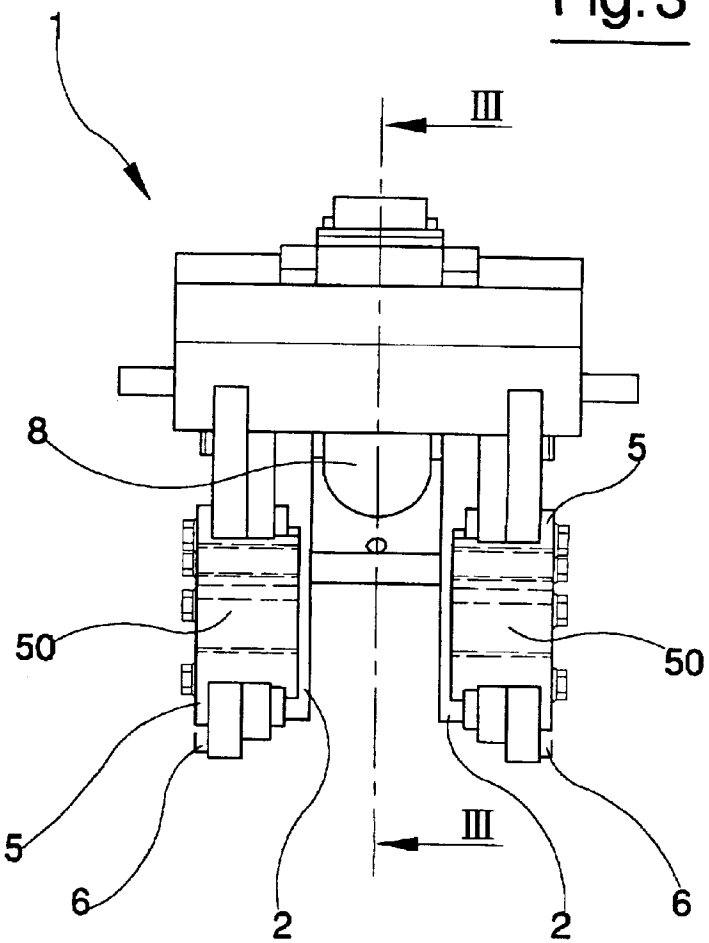
FIG. 3 is a schematic side view from the left of FIG. 2.
Figure 2:
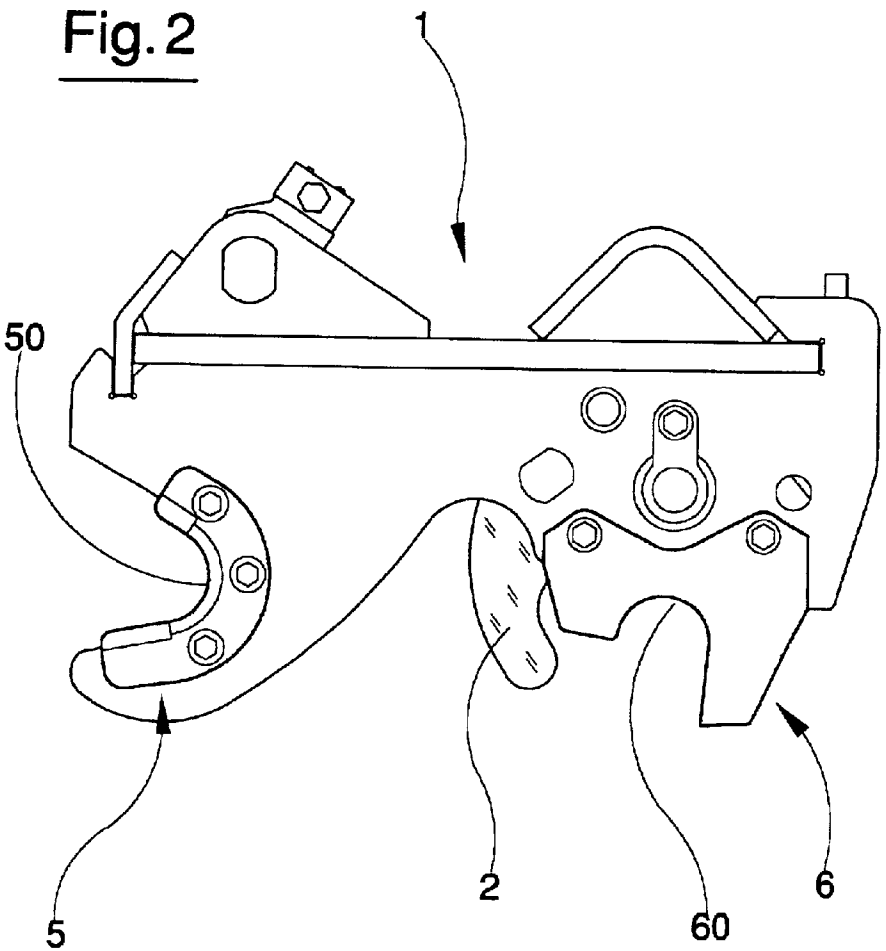
FIG. 2 is a side view of a detail of FIG. 1.
Figure 4:
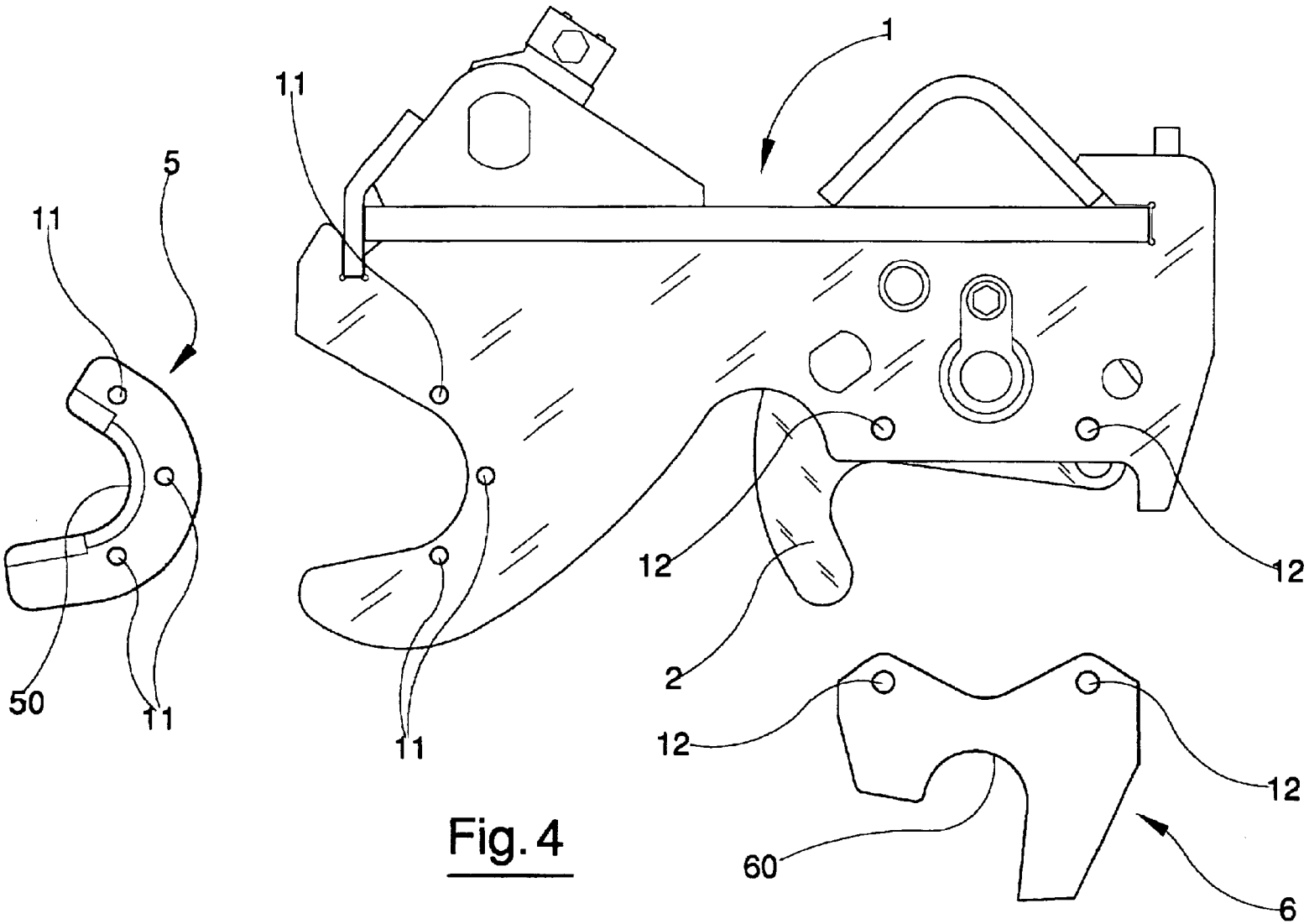
FIG. 4 is an exploded side view of a detail of FIG. 2.

With reference to the figures of the drawings, 1 denotes in its entirety the body of a rapid coupling device for digger tools, of the type in which the tool, in the figures denoted by 7, is provided with a first pivot 3 and a second pivot 4 which together constitute means by which the tool will be hooked up.

The body 1 is provided with blocking devices comprising mobile hooks 2 which achieve stable but removable couplings with at least one of the two pivots 3 and 4, and especially with the second pivot 4.

The hooking-up is achieved by coupling the pivots 3 and 4 in special coupling seatings 50 and 60 especially afforded in first supports 5 and second supports 6 which are removably fixed on the body 1.

Each body 1 is predisposed to receive a pair of first supports 5 and a pair of second supports 6. The supports of each pair are positioned in such a way that the surfaces of the seatings 50 and 60 are aligned so as to be able to couple respectively with the first pivots 3 and the second pivots 4.

The first supports 5 and the second supports 6 are mounted easily removably on the body 1, and can be constrained thereon in predetermined positions.

For each tool 7, i.e. for each hooking-up system constituted by a first pivot 3 and a second pivot 4, a set formed by a pair of first supports 5 and a pair of second supports 6 is provided. Thus by mounting the right supports 5 and 6 on the body 1, the desired tool can be fixed thereon.

It is not certain that in each case the above-described conditions will arise. It is perfectly possible that even with a plurality of different tools 7 it will be necessary only to have a corresponding plurality of first supports 5 but only one second support 6—or vice versa. In this case the first pivots 3 (or second pivots 4) of a plurality of tools 7, not very different in type one from another, can be coupled in a single seating 50 (or 60) of a first support 5 (or second support 6), the same seating being suitable for all of the tools 7, while the geometrical and dimensional difference in the attachment is present only in the seatings 60 (or 50) of the second supports 6 (or first supports).

More generally, there is a plurality of first supports 5 which corresponds to a plurality of second supports 6, which are predisposed to couple with a corresponding plurality of the first pivots 3 and the second pivots 4, and which can in all cases be removably fixed to the body 1.

The stability of the couplings is ensured by the fact that a single pair, formed by a first pivot 3 and a second pivot 4 on a single tool 7, is coupled with another pair constituted by first supports 5 and second supports 6.

The relative constraint between the first supports 5 and the body 1 is removable and uses the same references on the body for all the first supports 5.

The relative constraint between the second supports 6 and the body 1 is removable and uses the same references on the body for all the second supports 6.

In particular, the references are constituted by holes 11 made on the body 1 for allowing any first support 5 to be bolted thereon, and by other holes 12, also made on the body 1 for allowing any second support 6 to be bolted thereon.

The adaptation of the tool attachment to a specific tool 7 is made easy by making the attachment itself as a sort of modular structure which comprises a body 1, provided with mobile hooks 2 which in the illustrated embodiment are moved by a pneumatic cylinder 8, and a double plurality of pairs of first supports 5 and second supports 6 which are easily mountable on, and dismountable from, the body 1.

A special combination of first supports 5 and second supports 6 corresponds to each tool. When mounted on the body 1, by using the predetermined references, a rapid attachment can simply be obtained, which corresponds to the particular coupling dimensions of the single tool.

What is claimed is:

1. A rapid tool coupling device for digger tools, in which a tool is provided with two pivots operating as means for hooking-up, and comprising:

a body provided with devices for blocking, comprising mobile hooks which are actuated to achieve stable removable couplings with at least one of the two pivots;

at least one plurality of first supports of different configurations and at least one second support, which are predisposed to couple with a corresponding plurality of pairs of the two pivots, which pairs comprise a first pivot and a second pivot, and which supports are removably fixable to the body.

2. The rapid tool coupling device of claim 1, comprising a plurality of the first supports and a plurality of the second supports which are predisposed to couple with a corresponding plurality of the first pivots and the second pivots and which are removably fixable to the body.

3. The rapid tool coupling device of claim 2, wherein the first supports and the second supports are respectively provided with seatings for contactingly housing the first pivots and the second pivots; a pair formed by a first support and a second support corresponding to a single pair, formed by a first pivot and a second pivot equipping a single tool.

4. The rapid tool coupling device of claim 2, wherein the first supports and the second supports can be constrained to the body in predetermined positions, with removable constraints.

5. The rapid tool coupling device of claim 4, wherein the removable constraints use same reference points on the body for all the first supports.

6. The rapid tool coupling device of claim 4, wherein the removable constraints use same reference points on the body for all the second supports.

7. The rapid tool coupling device of claim 5, wherein the references are constituted by holes made on the body for allowing a connection by bolting of any of the first supports on the body.

8. The rapid tool coupling device of claim 6, wherein the references are constituted by holes made on the body for allowing a connection by bolting of any of the second supports on the body.

* * * * *